US008696160B2

(12) United States Patent
McClellan

(10) Patent No.: US 8,696,160 B2
(45) Date of Patent: Apr. 15, 2014

(54) MODULAR LED LIGHTING SYSTEM

(75) Inventor: Thomas David McClellan, Santa Cruz, CA (US)

(73) Assignee: Cool Lumens, Santa Cruz, CA (US)

( * ) Notice: Subject to any disclaimer, the term of this patent is extended or adjusted under 35 U.S.C. 154(b) by 233 days.

(21) Appl. No.: 13/291,752

(22) Filed: Nov. 8, 2011

(65) Prior Publication Data

US 2013/0114262 A1 May 9, 2013

(51) Int. Cl.
*F21V 21/00* (2006.01)

(52) U.S. Cl.
USPC ..... 362/249.02; 362/294

(58) Field of Classification Search
USPC ..... 362/249.02, 249.04, 249.14, 294, 269, 362/287
See application file for complete search history.

(56) References Cited

U.S. PATENT DOCUMENTS

| | | | | |
|---|---|---|---|---|
| 5,528,471 | A | 6/1996 | Green | |
| 8,138,690 | B2 | 3/2012 | Chemel | |
| 2006/0044859 | A1* | 3/2006 | Afzal et al. | 363/142 |
| 2006/0120104 | A1 | 6/2006 | Wasa et al. | |
| 2007/0223248 | A1 | 9/2007 | Han | |
| 2008/0285272 | A1 | 11/2008 | Simon | |
| 2009/0071637 | A1 | 3/2009 | Liao | |
| 2009/0085497 | A1 | 4/2009 | Osborn | |
| 2009/0129102 | A1 | 5/2009 | Xiao et al. | |
| 2009/0267540 | A1 | 10/2009 | Chemel | |
| 2010/0039793 | A1 | 2/2010 | Chen | |
| 2010/0126697 | A1 | 5/2010 | Huang | |
| 2010/0181889 | A1 | 7/2010 | Falicoff | |
| 2011/0199775 | A1 | 8/2011 | Bassani | |

FOREIGN PATENT DOCUMENTS

| | | | |
|---|---|---|---|
| WO | WO2006044859 | A1 | 4/2006 |
| WO | WO2011047104 | A1 | 4/2011 |

* cited by examiner

*Primary Examiner* — Ali Alavi
(74) *Attorney, Agent, or Firm* — Larry Guernsey; Patent Law Office of Larry Guernsey

(57) ABSTRACT

A modular lighting system, which includes at least one power supply, an expandable support frame and a number of LED lamps which are attached to the expandable support frame. Also a modular lighting system, including at least one power supply, a number of lamps, a number of hub assemblies, each hub assembly having at least one interlocking slot, and least one interlocking connector, which interlocks with one of the interlocking slots.

16 Claims, 19 Drawing Sheets

MODULAR LED LIGHTING SYSTEM

U.S. non-provisional patent application Ser. No. 12/902,041, entitled HEAT SINK AND LED COOLING SYSTEM is hereby incorporated by reference in the present application.

TECHNICAL FIELD

The present invention relates generally to illumination sources and more particularly to fixtures for directing LED illumination sources.

BACKGROUND ART

Overhead lighting sources have been used for centuries in providing illumination for living spaces, both personal and commercial. There is of course a great scope of variation in the size and configuration of these living spaces, and designing illumination sources which are adaptable within this great scope of variation is therefore also challenging. Living or commercial spaces are seldom strictly rectangular and often incorporate angles and corridors which can cause shadows and produce dimly lit areas, which may be undesirable for inhabitants and residents.

It is therefore advantageous to have a lighting system which is expandable, and which can be easily configured or re-configured to illuminated irregularly shaped areas, or areas in which the lighting needs may vary. A modular system which is expandable and adaptable may have great benefits when using illumination sources in living spaces.

One example of an illumination source which has become increasingly used in recent years is the LED. A Light-Emitting Diode (LED) is a semiconductor light source, which have many practical applications due to their longer lifetime, faster switching, smaller physical size, greater durability and higher energy efficiency. LEDs have many advantages over other illumination sources. LEDs are solid state devices and if operated at low currents and at low temperatures, are subject to very limited wear and tear. Typical lifetimes are estimated to be 35,000 to 50,000 hours of useful life, compared to 10,000 to 15,000 hours for fluorescent tubes, and 1,000-2,000 hours for incandescent light bulbs. LEDs are also less fragile than fluorescent and incandescent bulbs, and are less susceptible to damage by external vibration.

LEDs produce more light per watt than incandescent bulbs, and are ideal for use in applications that are subject to frequent on-off cycling, unlike fluorescent lamps that burn out more quickly when cycled frequently. LEDs can very easily be dimmed continuously unlike fluorescent lamps which require a certain threshold voltage to maintain illumination.

LEDs have been found to have significant environmental benefits compared to other alternatives. It has been estimated that a building's carbon footprint from lighting can be reduced by 68% by exchanging all incandescent bulbs for new LEDs. LEDs are also non-toxic compared to compact fluorescent, which contains traces of mercury. Organic light emitting diodes (OLEDs) can be produced that use an organic compound as the emitting layer material of the LED, which can be a polymer.

When confronting the challenge of illuminating irregular living spaces, it is of course possible to position independent fixtures wherever they are needed. However, there are advantages to having all the fixtures designed with a common appearance. Similar fixtures may also be more easily used to provide uniform lighting levels. Additionally, it may be desirable to have all the fixtures linked together electrically, so they may be programmed to operate together, to all turn on or off together in unison, or provide programmed levels of illumination together or in balance within the living space.

Thus, there are competing criteria in designing a lighting system. The system should be flexible enough to allow for a range of areas, dimensions and applications. These competing criteria are especially difficult to satisfy when a number of different lighting sources are used, each having its own weight and bulk considerations. It would be advantageous therefore to have a lighting system utilizing uniform lighting sources, which are still individually controllable. A unified look to the illumination system also has aesthetic advantages.

Thus, there is need for a modular lighting system that can be modified or configured to accommodate a variety of living space configurations, has individually controllable operation, and especially a system that utilizes LED illumination sources for longer life performance and energy efficiency.

DISCLOSURE OF INVENTION

Briefly, one preferred embodiment of the present invention is a modular lighting system, which includes at least one power supply, an expandable support frame and a number of LED lamps which are attached to the expandable support frame.

Also disclosed is a modular lighting system, including at least one power supply, a number of lamps, a number of hub assemblies, each hub assembly having at least one interlocking slot, and least one interlocking connector, which interlocks with one of the interlocking slots.

An advantage of the present invention is that a system of lighting is presented which is modular, so that the system can be easily expanded for use with a great variety of living or commercial spaces.

Another advantage of the present invention is that it provides a system which allows for a great number of spatial configurations of different types and sizes.

Still another advantage of the present invention is it utilizes a support frame comprising elements with interlocking flanges which are easily assembled and reassembled into a great number of configurations.

Yet another advantage of the system of the present invention is it is mainly comprised of a small number of types of standardized components, such as 6-slot, 8-slot or end hubs and connectors, which are easily manufactured, and these components can be then combined to produce a great number of different unique configurations.

A further advantage of the present invention is that it uses LED lighting sources which are more efficient and longer lasting than incandescent or fluorescent lamps.

And another advantage of the present invention is that by encouraging the use of more reliable LEDs, there are environmental benefits such as reducing carbon footprints of lighting devices.

A further advantage of the present invention is that the preferred LED lights are used with a tapered LED heat sink assembly configured as a finned concentric tube configuration, which extends the working life of LEDs by providing better cooling.

An additional advantage of the present invention is that the tapered LED heat sink assembly configured as a finned concentric tube configuration is lighter weight than previous finned concentric tube configuration LED heat sink assemblies, produces better cooling of LEDs and thus improves performance.

Another advantage of the present invention is that the tapered LED heat sink assemblies allow multiple focal optics to change the beam spread according to ceiling height. The heat sink device allows many different lens choices such as clear, frosted, linear, prismatic, etc, for all different applications such as commercial, industrial, retail etc.

These and other advantages of the present invention will become clear to those skilled in the art in view of the description of the best presently known modes of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

DETAILED DESCRIPTION OF THE PREFERRED EMBODIMENTS

The present invention is a modular LED lighting system, which will be referred to by the reference number 10, and thus shall be referred to as lighting system 10. Being a modular system, many different configurations are possible. Included in this specification are five preferred embodiments of the lighting system 10 which are illustrated in FIGS. 1-16, and these figures will be referred to generally in the following discussion.

Figure 1:
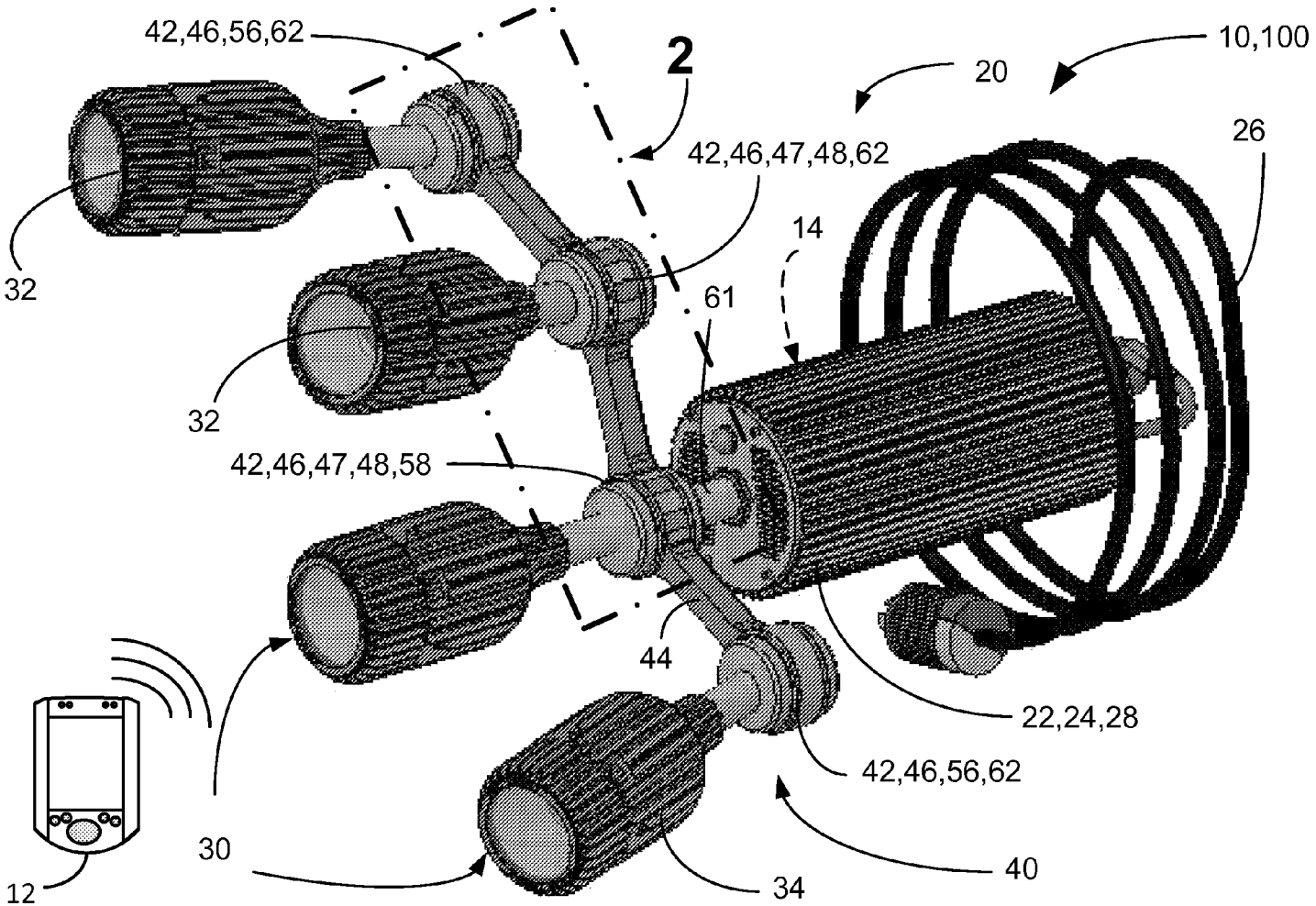
FIG. 1 shows an isometric bottom view of the zig-zag embodiment of the modular lighting system of the present invention.

FIG. 1 shows an isometric bottom view of one embodiment of the lighting system 10 of the present invention, which is of a configuration which will be referred to as a zig-zag configuration 100. As will be seen, this zig-zag configuration 100 is only one of a great number of configurations which can be constructed from the elements of the lighting system 10.

Within the larger construction of the lighting system 10, it is convenient to identify smaller units, which will be referred to as modules 20. A module 20 will be considered to include a power supply 22, having a housing 24, which in this example is a circular housing 28, and power cord 26. A module 20 also includes a number of lamps 30, in this case four lamps, which preferably include LED lamps 32, which are housed in heat-sinks 34. A module 20 also includes an expandable support frame 40, which include a number of hub assemblies 42, of which there are numerous types, and interlocking connectors 44.

Figure 2:
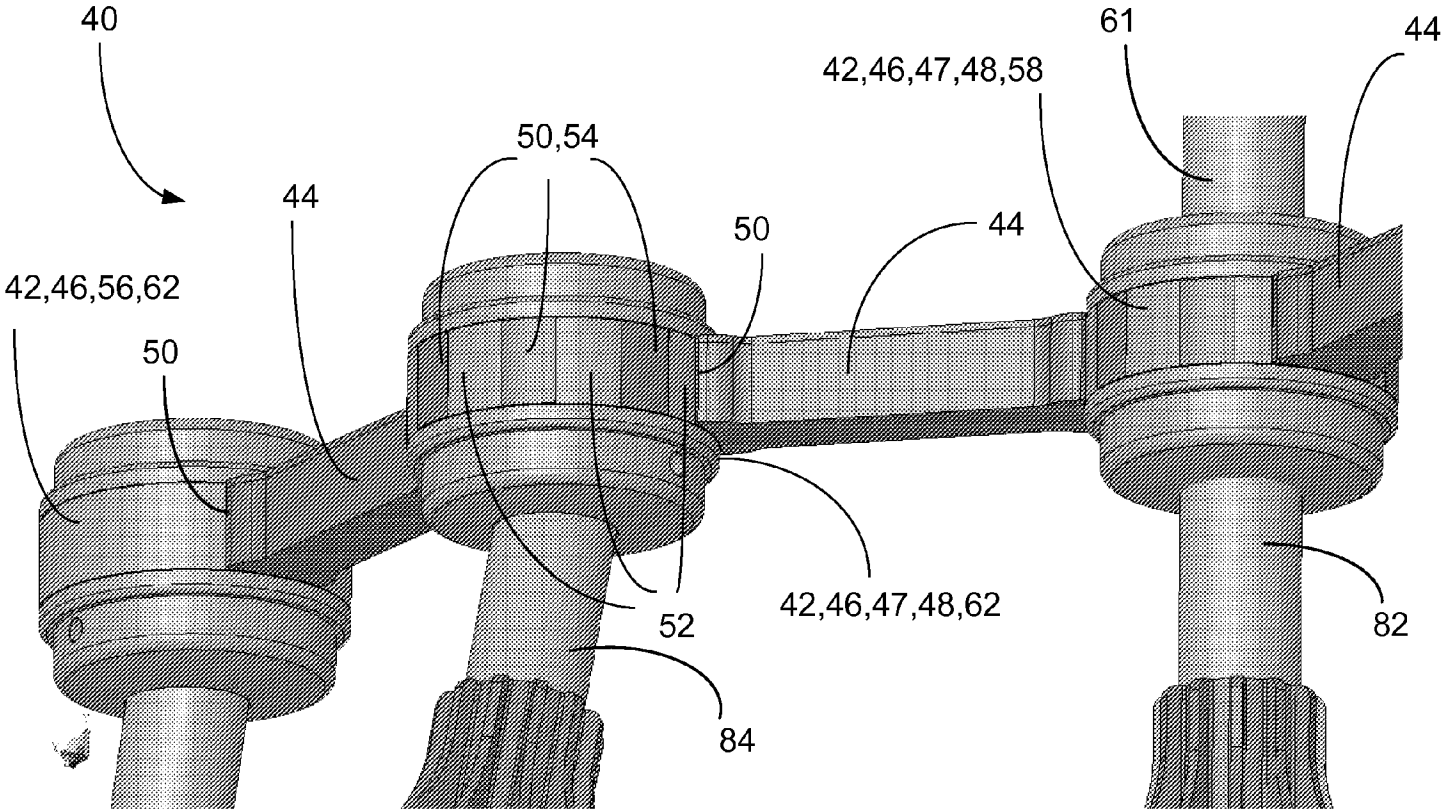
FIG. 2 shows a detail view of the area enclosed by rectangle 2 of FIG. 1.

A detail view of hub assemblies 42 and interlocking connectors 44 is seen in FIG. 2, which is a detail view of the elements in detail box 2 of FIG. 1. As referred to above, the hub assemblies may be of various types. Three hub assemblies 42 are seen in FIG. 2, of which the middle and right-hand hub assemblies 42 include hubs 46 which are of a configuration to be called an eight-slot hub 48, which is one example of a more general category of multi-slot hub 47. This is because there are eight interlocking slots 50 opened in the peripheral wall 52 of the interlocking hub 46. Two interlocking connectors 44 have been inserted into two of the interlocking slots 50, and are thus attached to the interlocking hub 46. The remaining six of the eight slots are filled by plugs 54 which are used to close the empty unused slots 50.

The hub assembly 42 on the left-hand side is at the end of the zig-zag configuration 100, and is thus configured as an end hub 56, having only a single interlocking slot 50, which is filled by a single connector 44.

Referring now back to FIG. 1, the zig-zag configuration 100 shown thus includes two eight-slot hubs 48 and two end hubs 56, with four lamps 30, one for each of the four hubs 46. This is not to be construed as a limitation, and it is apparent that either of the end hubs 56 could be replaced with eight-slot hubs 48 and the expandable support frame 40 thus extended to five, six or more hubs and lamps. It is also apparent that the lamps 30 could have been arranged in a straight line rather than a zig-zag, depending on which interlocking slots 50 the interlocking connectors 44 are inserted in the hub assemblies 42.

It will be noted that one of the eight-slot hubs 48 is attached directly to the power supply 22, by a power conduit 61 and thus will be referred to as a direct hub 58. Electrical wiring 60 (not visible in this view) passes directly into this direct hub 58, as well as wiring that is routed to the other non-direct hubs 62 through interlocking connectors 44, eventually to be connected to the lamps 30.

Figure 3:
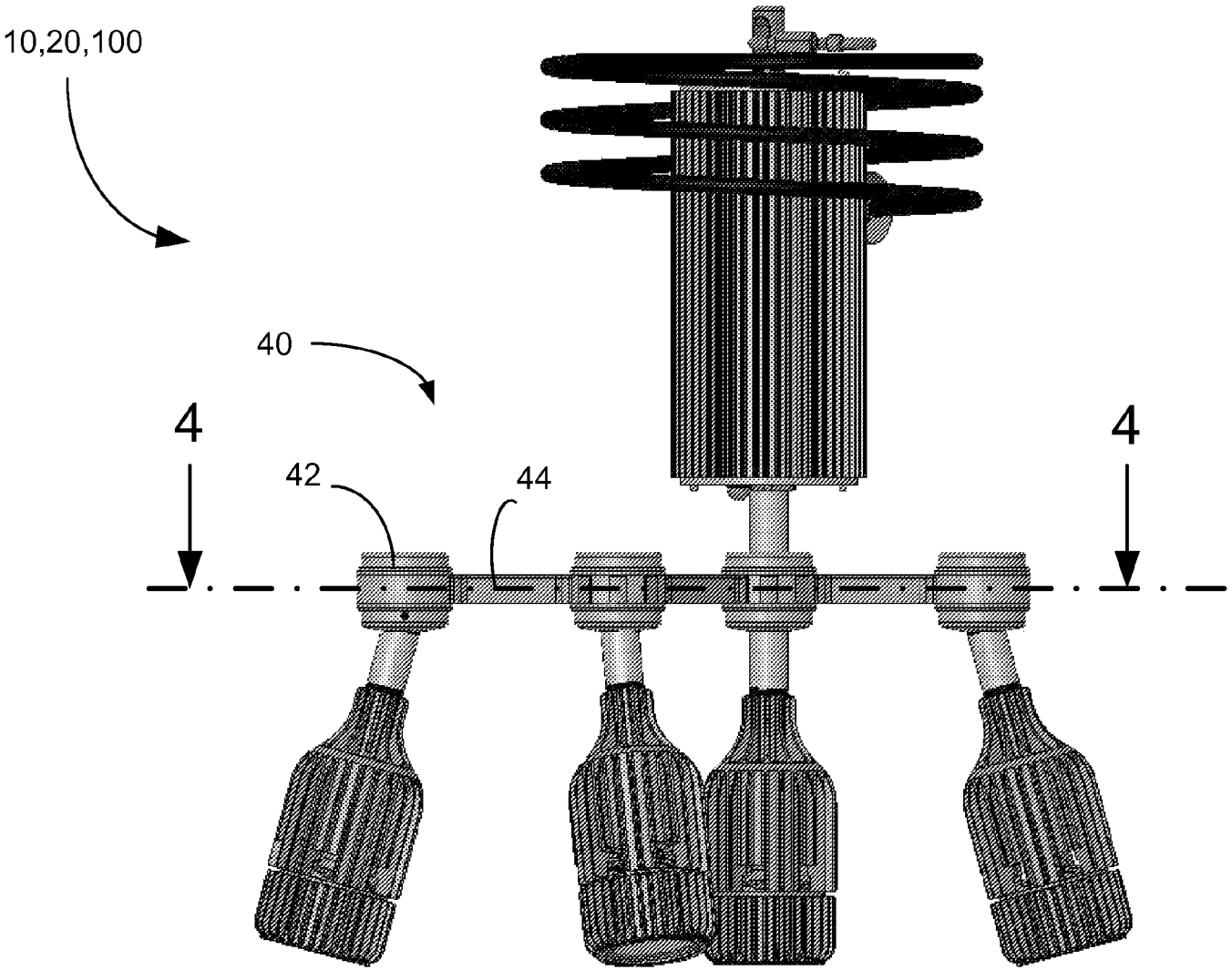
FIG. 3 shows a side view of a zig-zag modular lighting system of the present invention.
Figure 4:
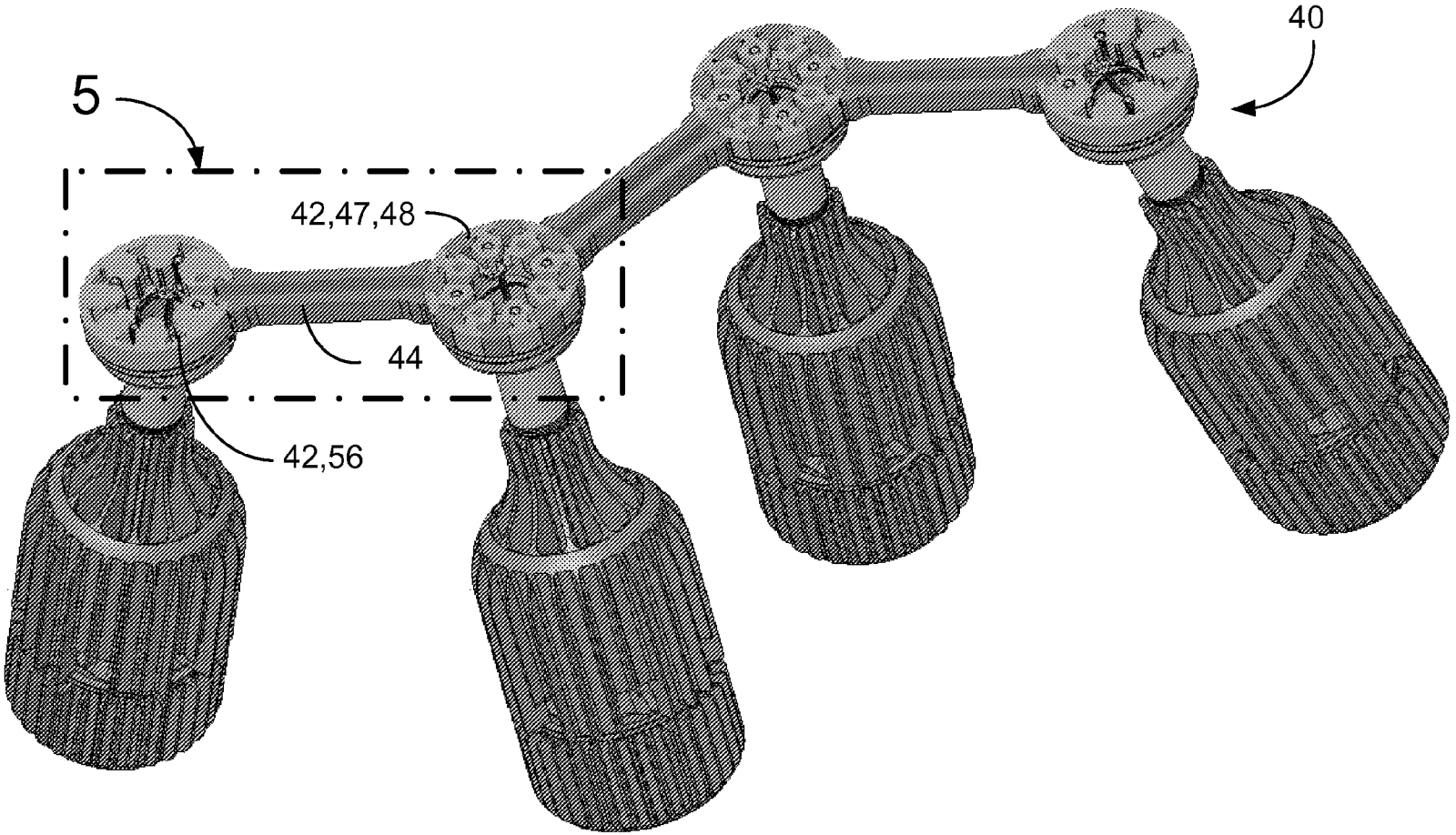
FIG. 4 shows a cross-section view taken through line 4-4 of FIG. 3.

FIG. 3 shows a left-side view of the module 20, for which a cross-section has been taken at line 4-4 through the expandable support frame 40. FIG. 4 is an isometric view of this cross-section as seen from above, indicated by the line-of-sight direction arrows in FIG. 3. From this view, the interiors of the hub assemblies 42 and interlocking connectors 44 can be seen.

Figure 5:
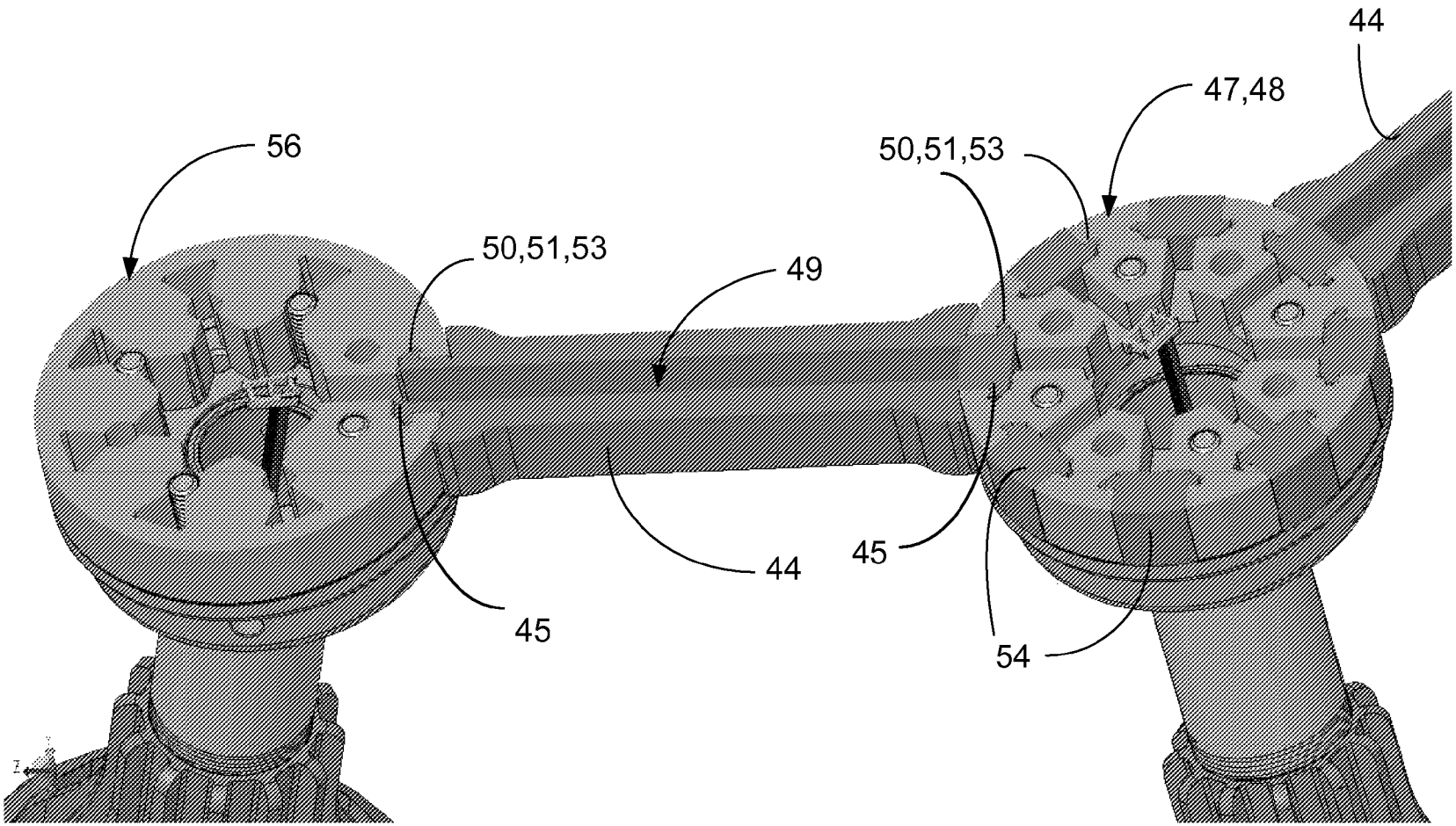
FIG. 5 shows a detail isometric view of the area enclosed by rectangle 5 of FIG. 4.

A detail view of this cross-section is taken from the rectangular area labeled 5, in FIG. 4, and is shown in more detail in FIG. 5.

In FIG. 5, the multi-slot hub 47, which is an eight-slot hub 48, and an end hub 56 are shown being connected by an interlocking connector 44. The eight-slot hub 48 has two of the eight interlocking slots 50 filled with connectors 44, and the other six slots are filled with plugs 54. The end hub 56 has only one interlocking slot 50, which is filled with an interlocking connector 44. It can be seen that both ends of the interlocking connector 44 have flanges 45, which mate with the slot flange recesses 51 of the interlocking slots 50. The interlocking connectors 44 are thus connected to the hubs 48, 56 by introducing them from above in the YZ plane, so that the connector flanges 45, and the slot flange recesses 51 interlock and prevent movement between the hubs 48, 56 in the XZ plane. The connector flanges 45 and the slot flange recesses 51 will thus be referred to generally as interlocking flanges 53. The plugs 54 are also designed with flanges 45, so they also interlock with the slot flange recesses 51 to keep them in place.

As will be discussed below, an end cap (not shown here) is later affixed into place which prevents the connector from leaving the slot in the YZ plane from the direction from which it entered, and the connector is captured in place.

It can also be seen that there is a hollow channel 49 in the body of the connector 44. This can be used for channeling the electrical wiring (not shown) from the power supply 22 to the lamps 30 (see FIG. 1)

Figure 6:
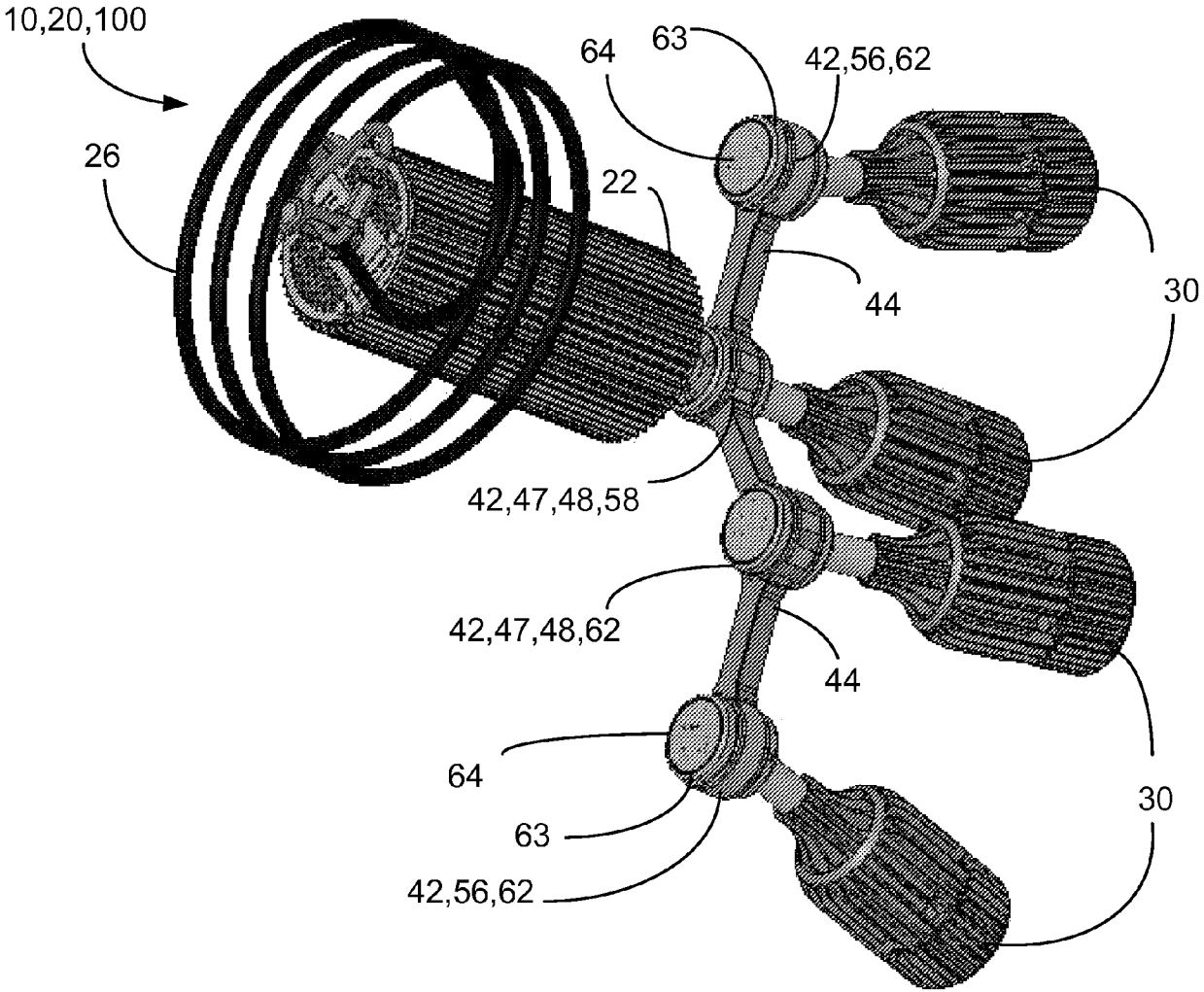
FIG. 6 shows a top isometric view of the zig-zag embodiment of the modular lighting system of the present invention.
Figure 7:
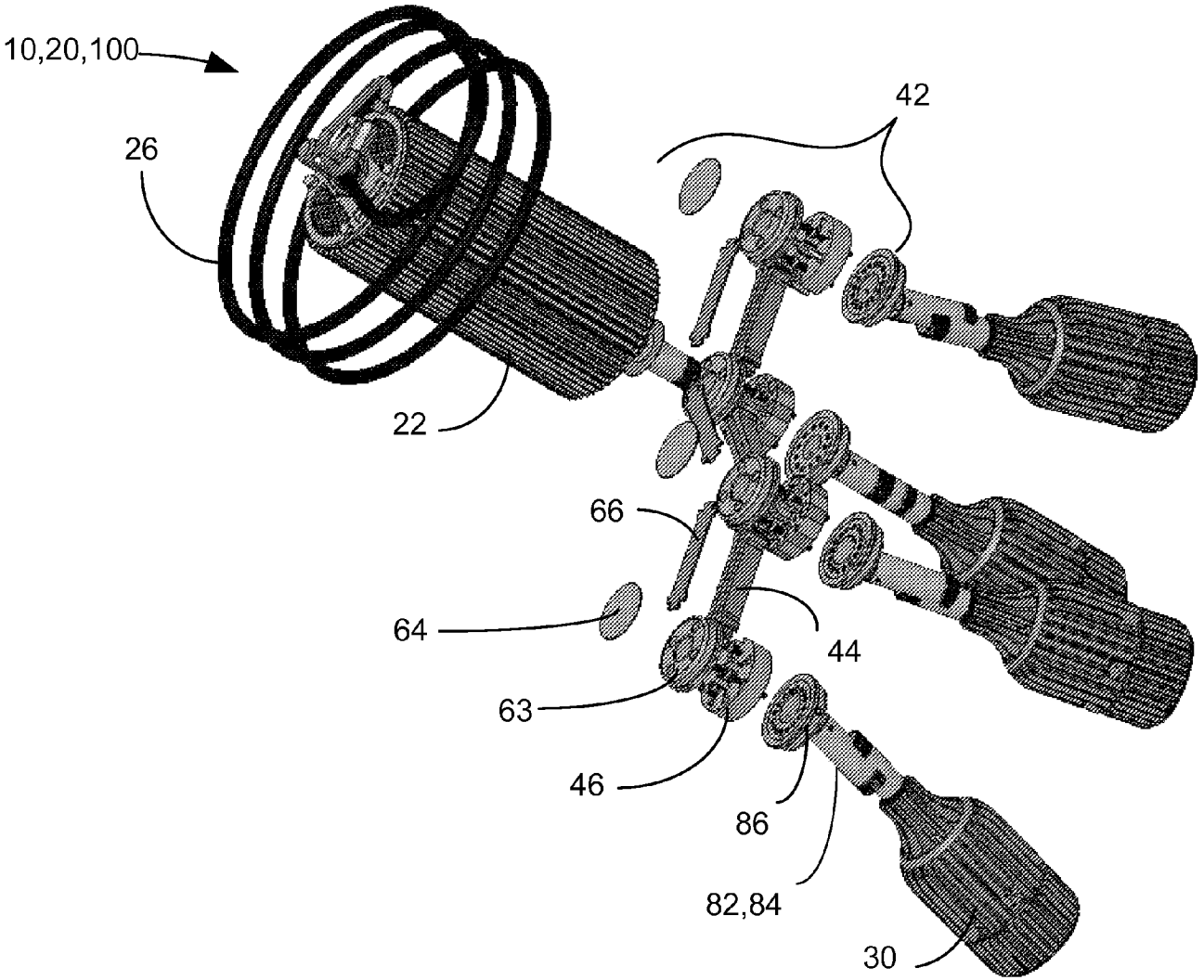
FIG. 7 shows an exploded top isometric view of the zig-zag embodiment of the modular lighting system of the present invention.

FIGS. 6 and 7 shows a rear isometric view of a zig-zag configuration 100 module 20. It can be seen that the three non-direct hubs 62 are fitted with screw plates 63 and end caps 64, which keep the interlocking connectors 44 locked with the interlocking hubs 46, and maintain the assembly of the hub assemblies 42. The interlocking connectors 44 also have connector caps 66. The lamps 30 are shown to be connected to the expandable support frame 40 by support tubes 82, of which there are several types, to be discussed below FIG. 7 shows an exploded isometric view of a zig-zag configuration 100 module 20, which shows most of the components included in the module 20.

Figure 8:
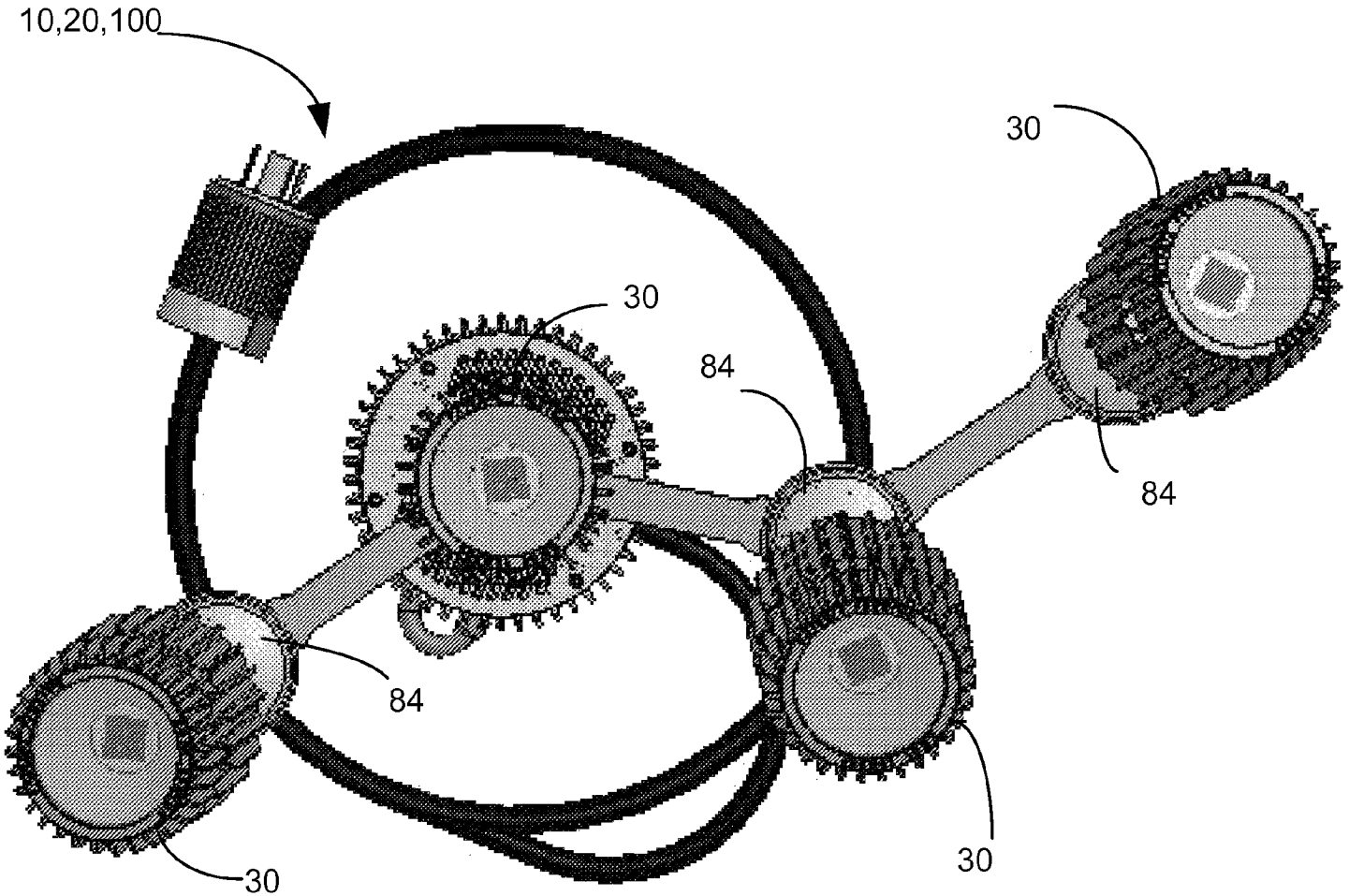
FIG. 8 shows a bottom plan view of the zig-zag embodiment of the modular lighting system of the present invention.

FIG. 8 shows a bottom view of the zig-zag configuration 100 module 20 from which it can be seen that the lamps 30 are directed at various angles by use of angled support tubes 84, which will be discussed in more detail below The zig-zag configuration 100 is of course, only one of many possible configurations that can be constructed using eight-slot hubs and end hubs. FIGS. 9-14 include pairs of bottom and isometric views of three other useful configurations which constitute alternate preferred embodiments. These are shown for purposes of illustration, and of course, the configurations possible are not limited to these.

Figure 9:
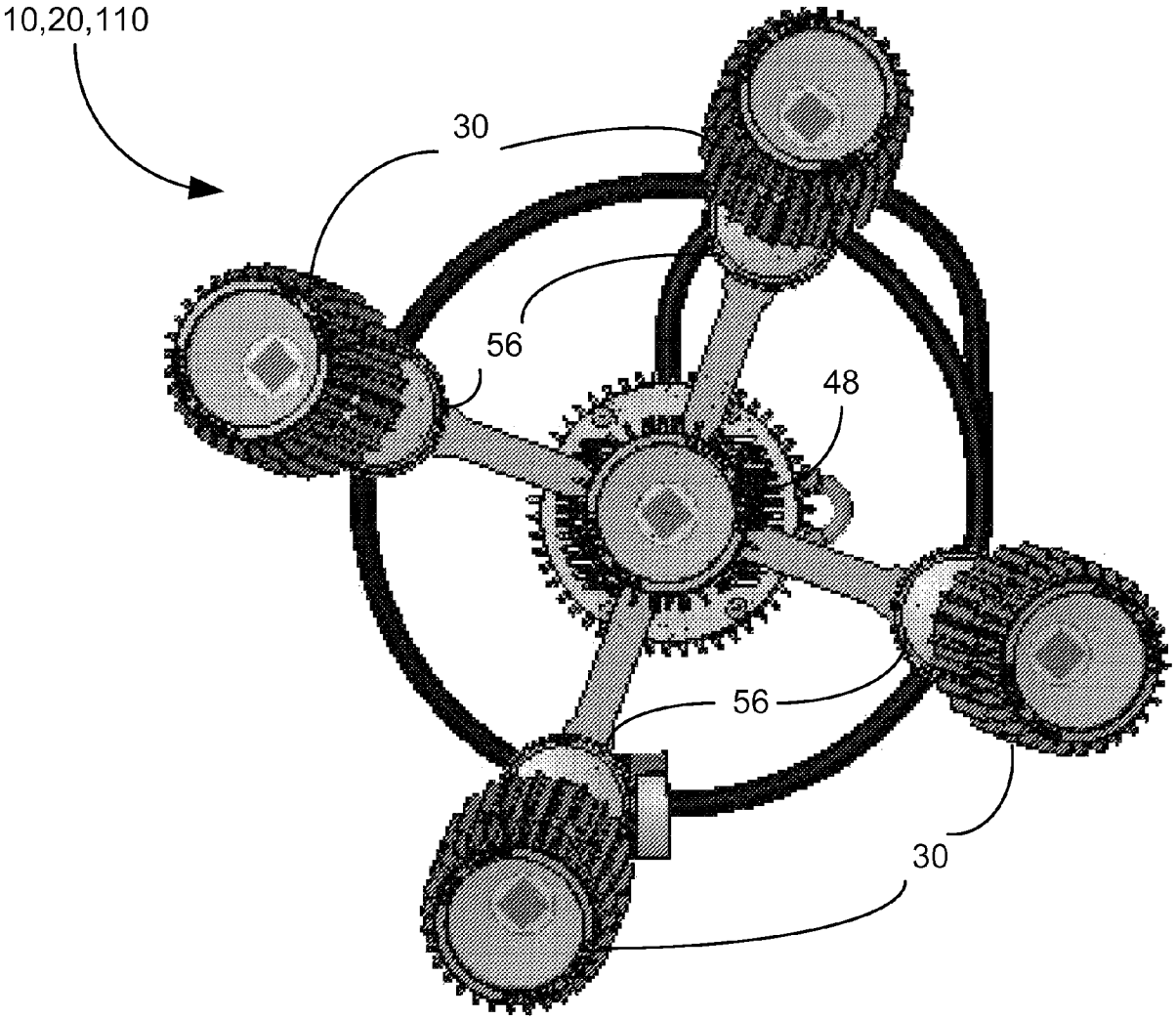
FIG. 9 shows a bottom plan view of the five lamp configuration embodiment of the modular lighting system of the present invention.
Figure 10:
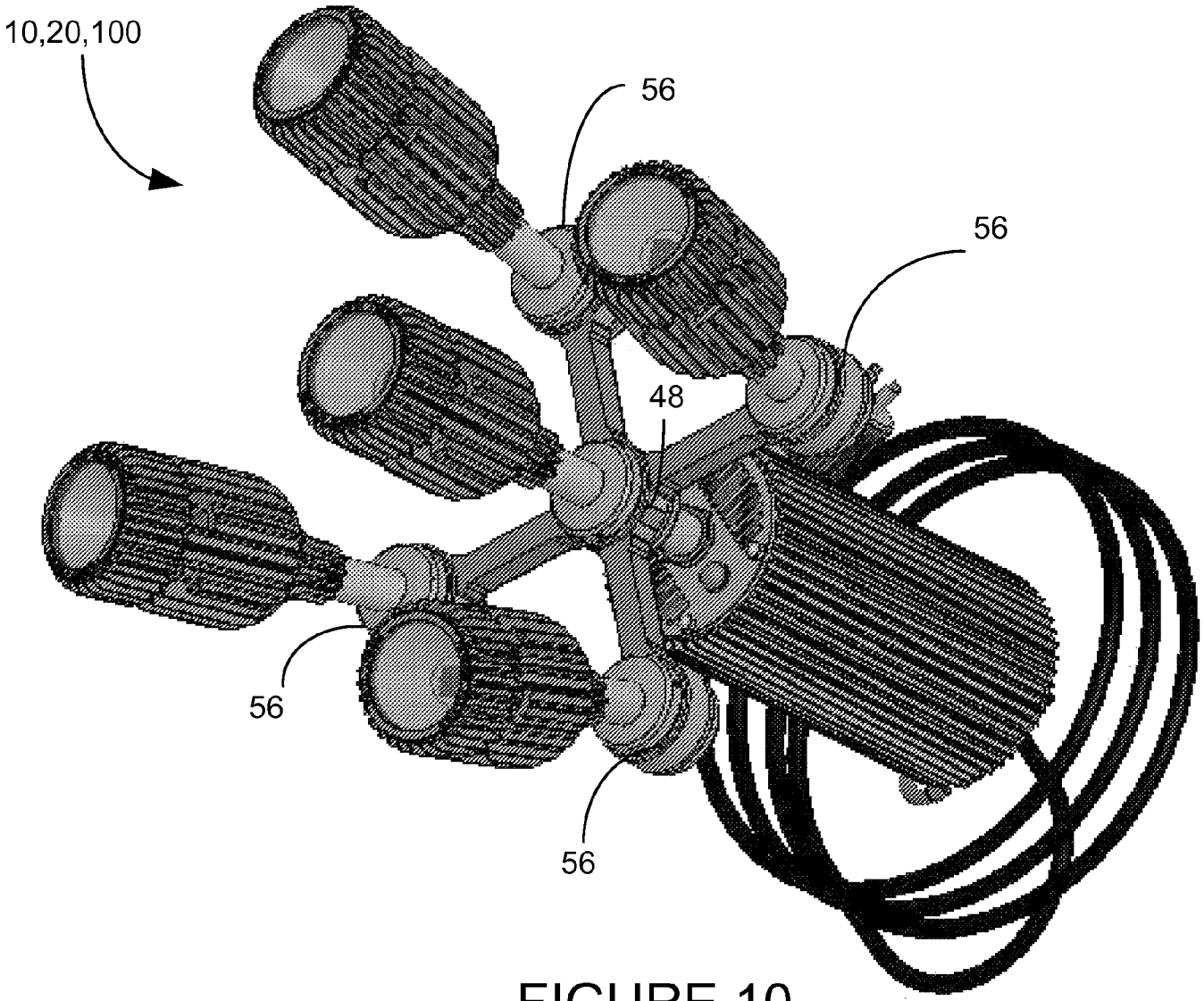
FIG. 10 shows a bottom isometric view of the five lamp configuration embodiment of the modular lighting system of the present invention.

FIGS. 9 and 10 are bottom and isometric views of a five-lamp configuration 110 which has been constructed using an eight-slot hub 48 and four end hubs 56.

Figure 11:
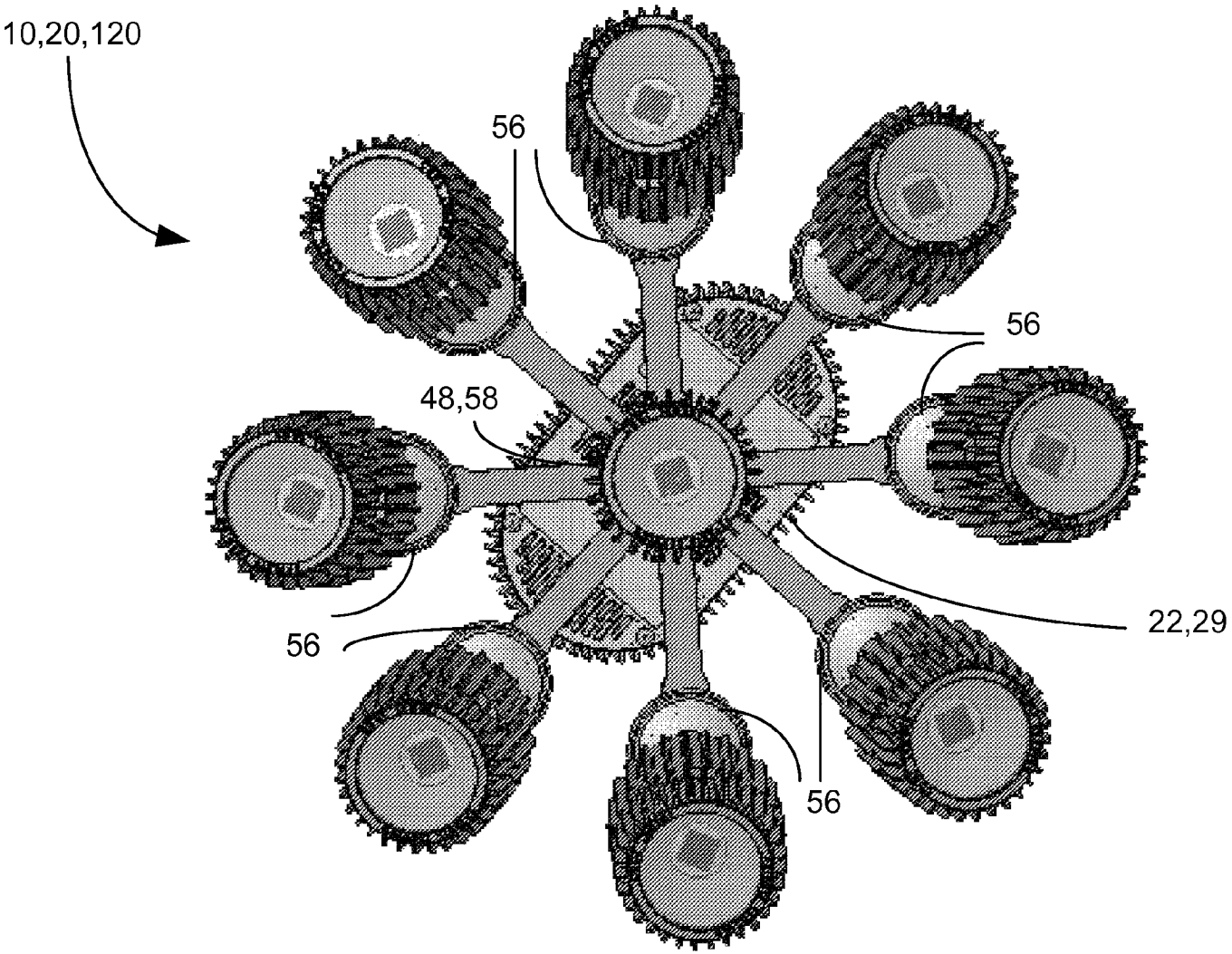
FIG. 11 shows a bottom plan view of the nine lamp star configuration embodiment of the modular lighting system of the present invention.
Figure 12:
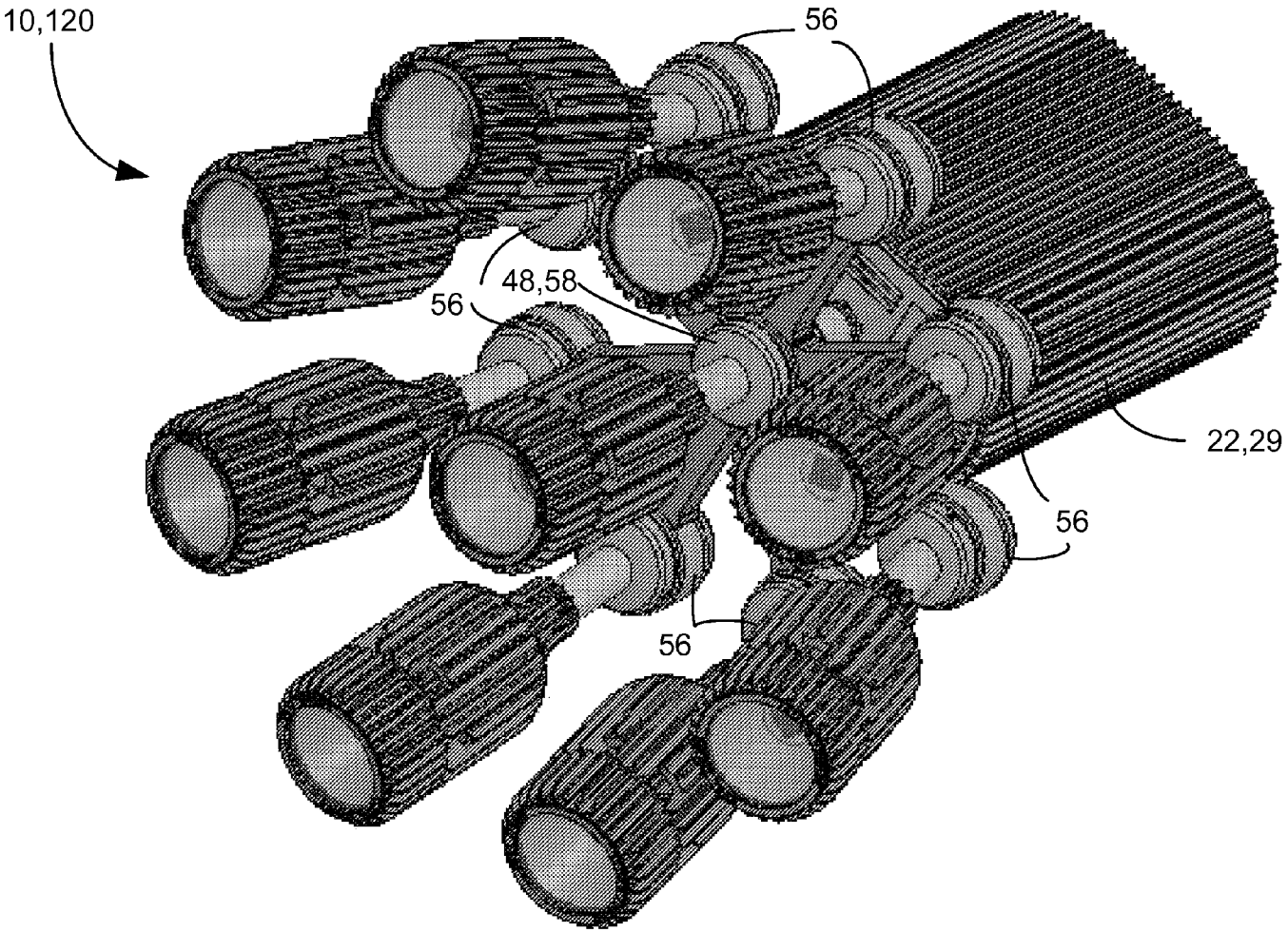
FIG. 12 shows a bottom isometric view of the nine lamp star configuration embodiment of the modular lighting system of the present invention.

FIGS. 11 and 12 are bottom and isometric views of a nine-lamp star configuration 120 which has been constructed from a central eight-slot hub 48 and eight end hubs 56, where connectors 44 radiate from the central direct hub 58 in a star shape. It can be noted that the power supply 22 is not circular in cross-section, but is an ovoid power supply 29, which may be useful when a larger number of lamps is being powered by providing more interior space for the power supply components.

Figure 13:
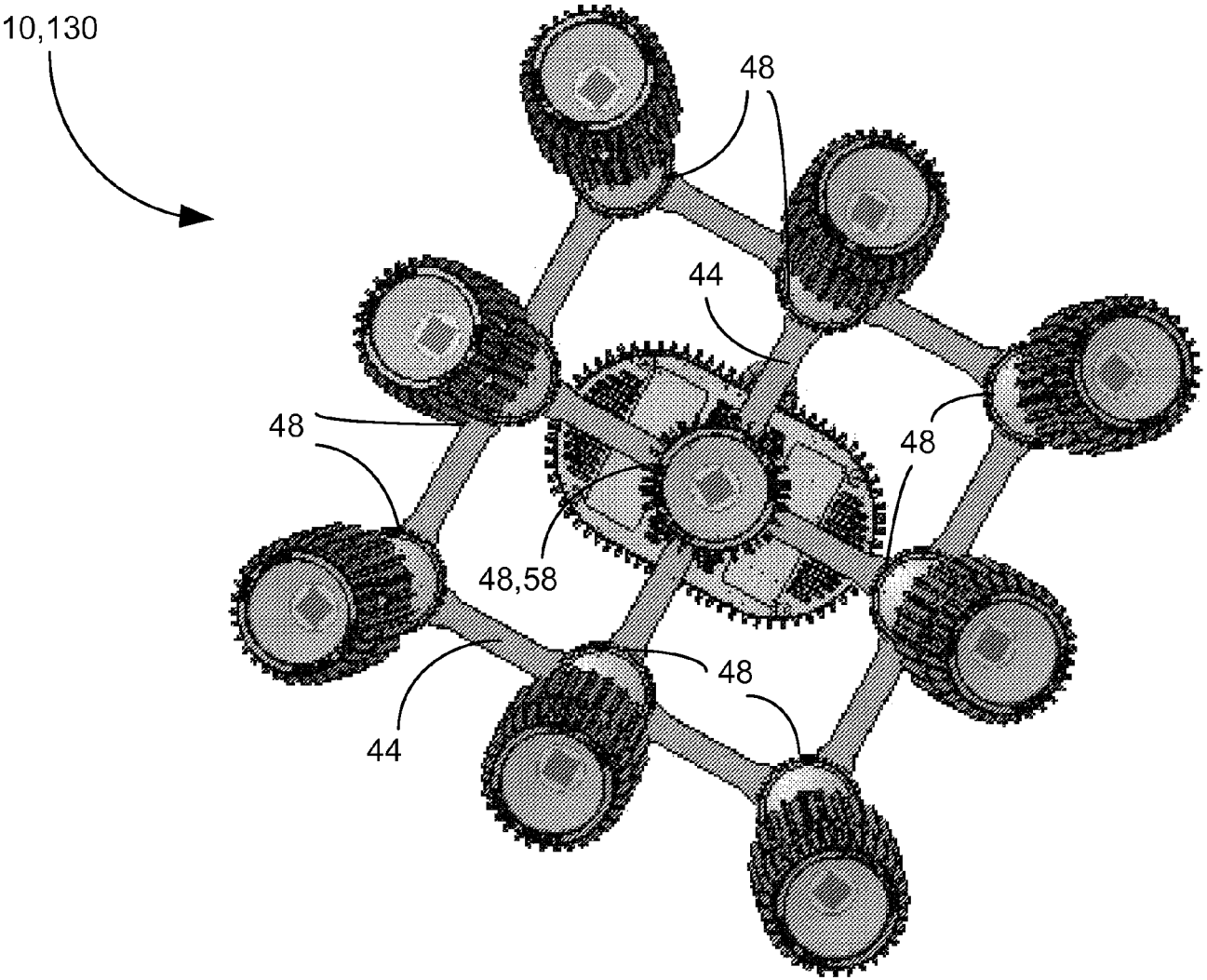
FIG. 13 shows a bottom plan view of the nine lamp square configuration embodiment of the modular lighting system of the present invention.
Figure 14:
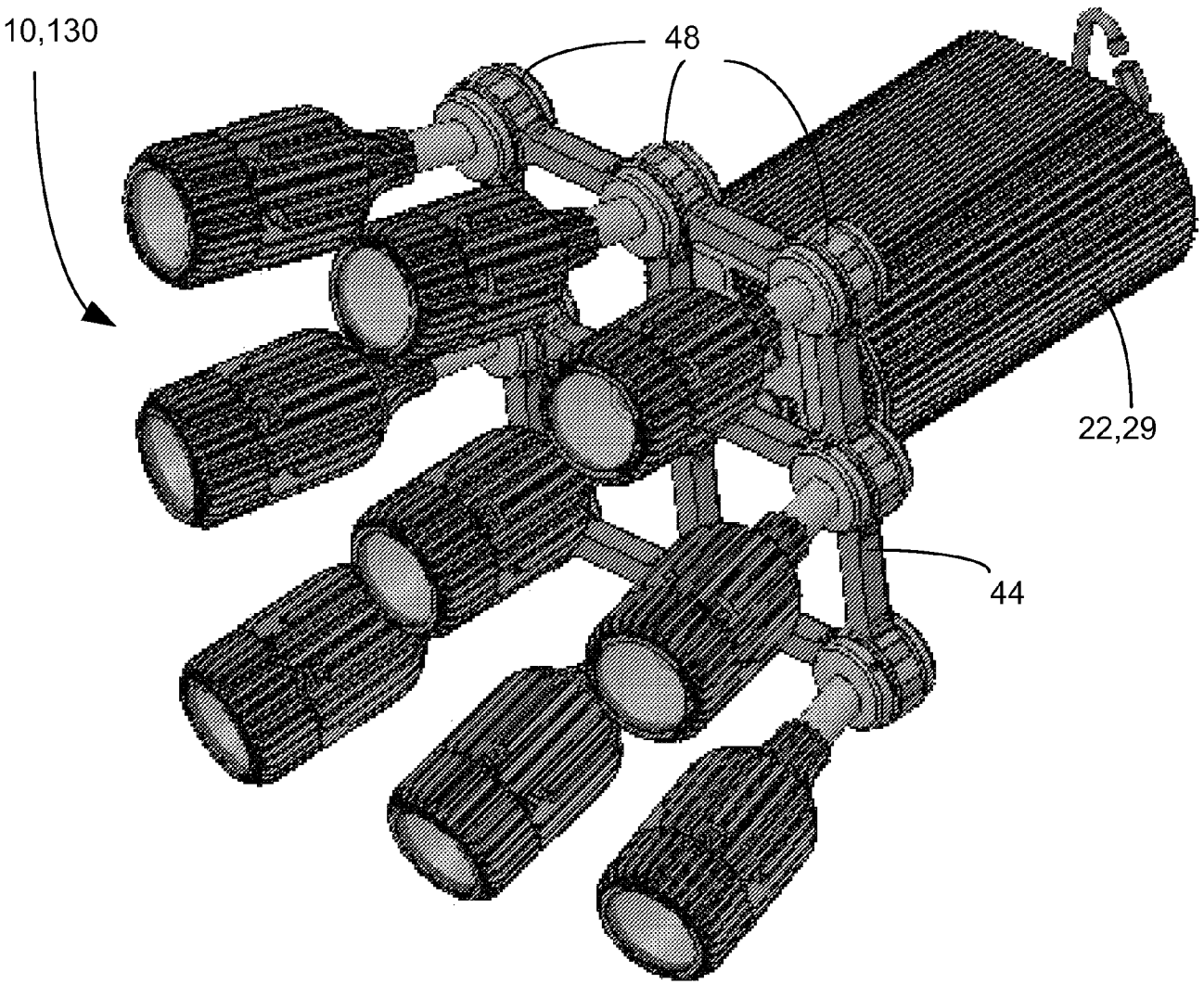
FIG. 14 shows a bottom isometric view of the nine lamp square configuration embodiment of the modular lighting system of the present invention.

FIGS. 13 and 14 are bottom and isometric views of a nine-lamp square configuration 130 which has been constructed from a central eight-slot hub 48 and eight more eight-slot hubs 48, where four connectors 44 radiate from the central direct hub 58 in an X-shape, and eight additional connectors 44 are used to create a square shape.

It will be apparent that the hubs do not need to be configured only with either eight slots or only one slot. The multi-slot hubs could be designed with 2, 3, 4, or almost any other number of slots, as long as there is enough material after the slots have been removed from the peripheral wall that the hub is physically capable of supporting the desired number of connectors.

Figure 15:
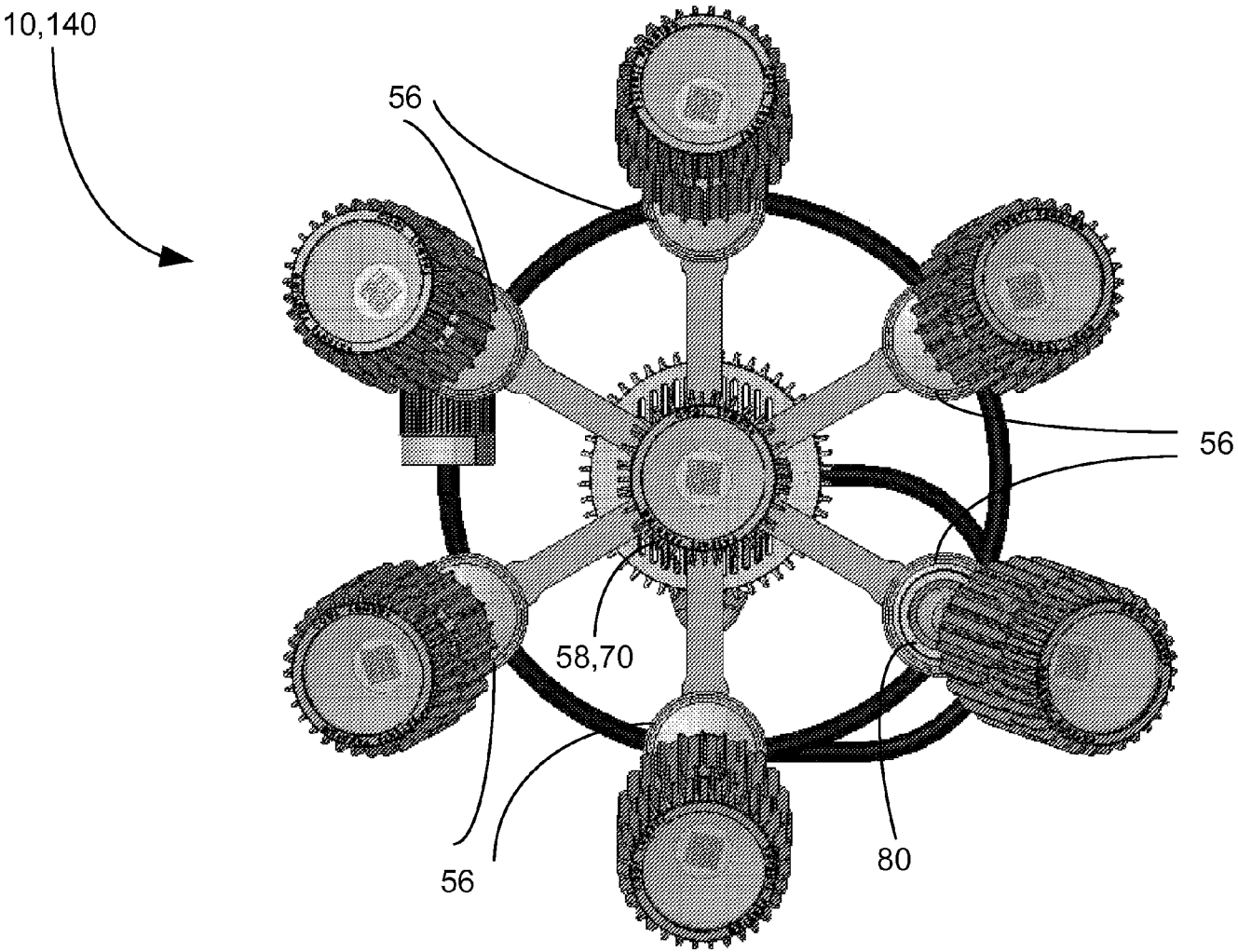
FIG. 15 shows a bottom plan view of the seven lamp star configuration embodiment of the modular lighting system of the present invention.
Figure 16:
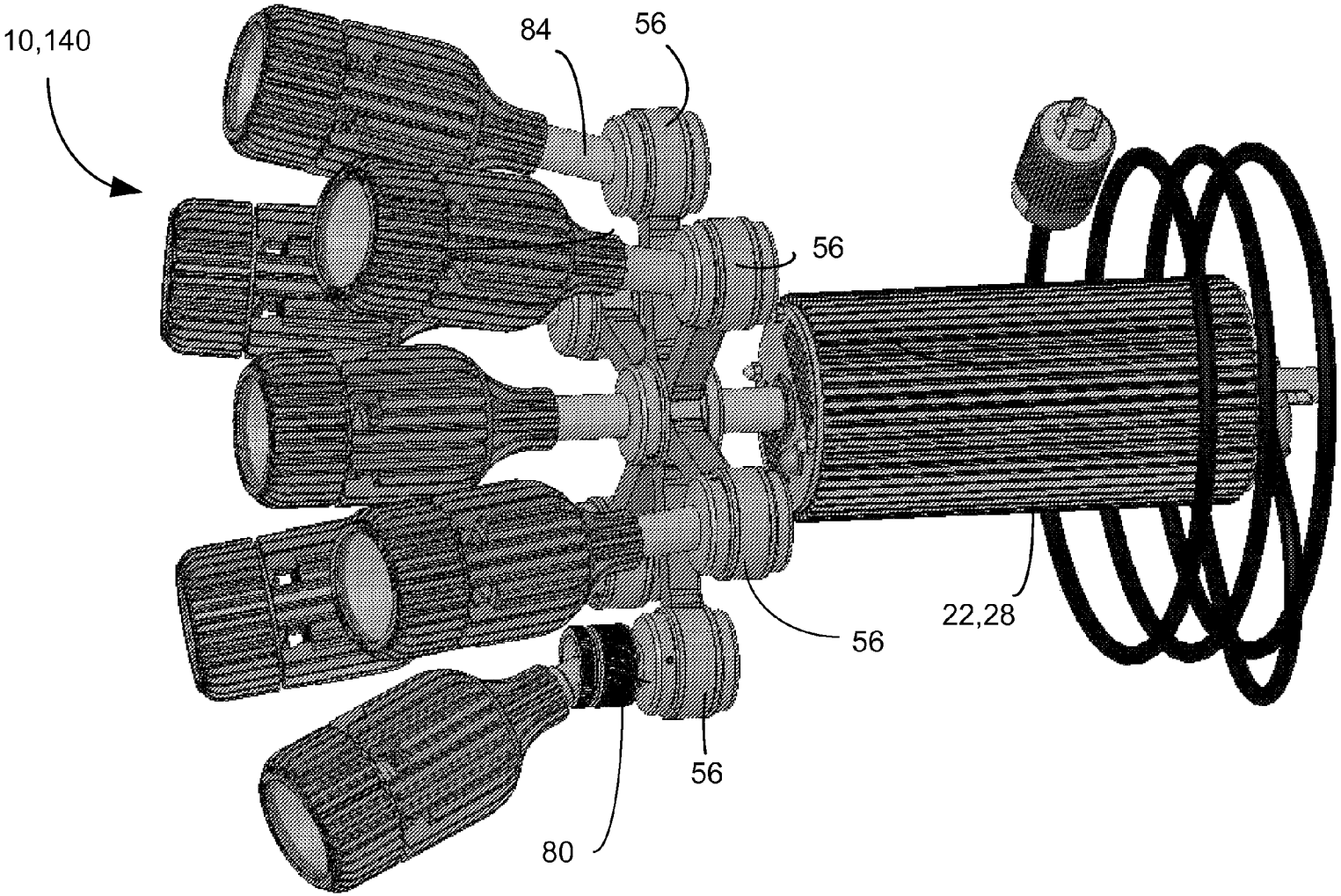
FIG. 16 shows a bottom isometric view of the seven lamp star configuration embodiment of the modular lighting system of the present invention.

In particular, a six-slot hub is an example of a multi-slot hub that has been found to be useful. FIGS. 15 and 16 show bottom and isometric views of a seven lamp star configuration 140, which uses a central six-slot hub 70, which is a direct hub 58, and six end hubs 56 in a star-shaped pattern. This is only one example of the variations in hub design and modular configuration that can be created using the present invention.

It has been found to be useful to have one power supply for each nine lamps, mostly for ease of programming the illumination areas, but this is not to be construed as a limitation. The embodiments shown so far have all utilized only one power supply, but it will be obvious that more elaborate configurations can be constructed with the support frame structures of several different modules linking up to create a network of hubs and connectors that can cover a great expanse of area, and yet be very adaptable to angles and corridors in the living space to be illuminated.

It is of course useful to direct the lamps to provide lighting at the desired angles for illuminating certain portions of a living space. This is done in several different ways in the present modular LED lighting system. The support tubes 82 (see FIG. 7) which connect the lamps 30 to the hub assemblies 42 may be straight, or they may be configured at an angle. Several examples of these angled support tubes 84 can be seen throughout the previous figures, but are especially noted on FIG. 16. These angled support tubes 84 are preferably set at an angle which can be set at 0 degree, 10 degree, 15 degree and 20 degree or alternatively, an adjustable swivel may be used, but this is not to be construed as a limitation. The angled support tubes 84 include a base plate portion 86 (see FIG. 7), which during assembly can be rotated to a number of positions somewhat like the numerals on a clock face. This allows the angle at which the lamps are directed to be customized. During assembly, the base plate 86 is rotated so that the corresponding lamp is angled, say away from the center of the module, or towards it, or to the right or left side, etc. The base plate 86 is locked in place when assembly screws are inserted through holes in the screw plate 63, to the correct holes in the base plate 86, and tightened. Thus, the angled support tube 84 is angled as desired, and light can be directed to whatever corner or area is needed.

Alternatively, a support tube may be replaced by a swivel fixture 80, which allows very easy direction or re-direction of light to whatever area is desired. FIGS. 15 and 16 show one such swivel fixture 80 mounted on the seven light star configuration 140.

Figure 17:
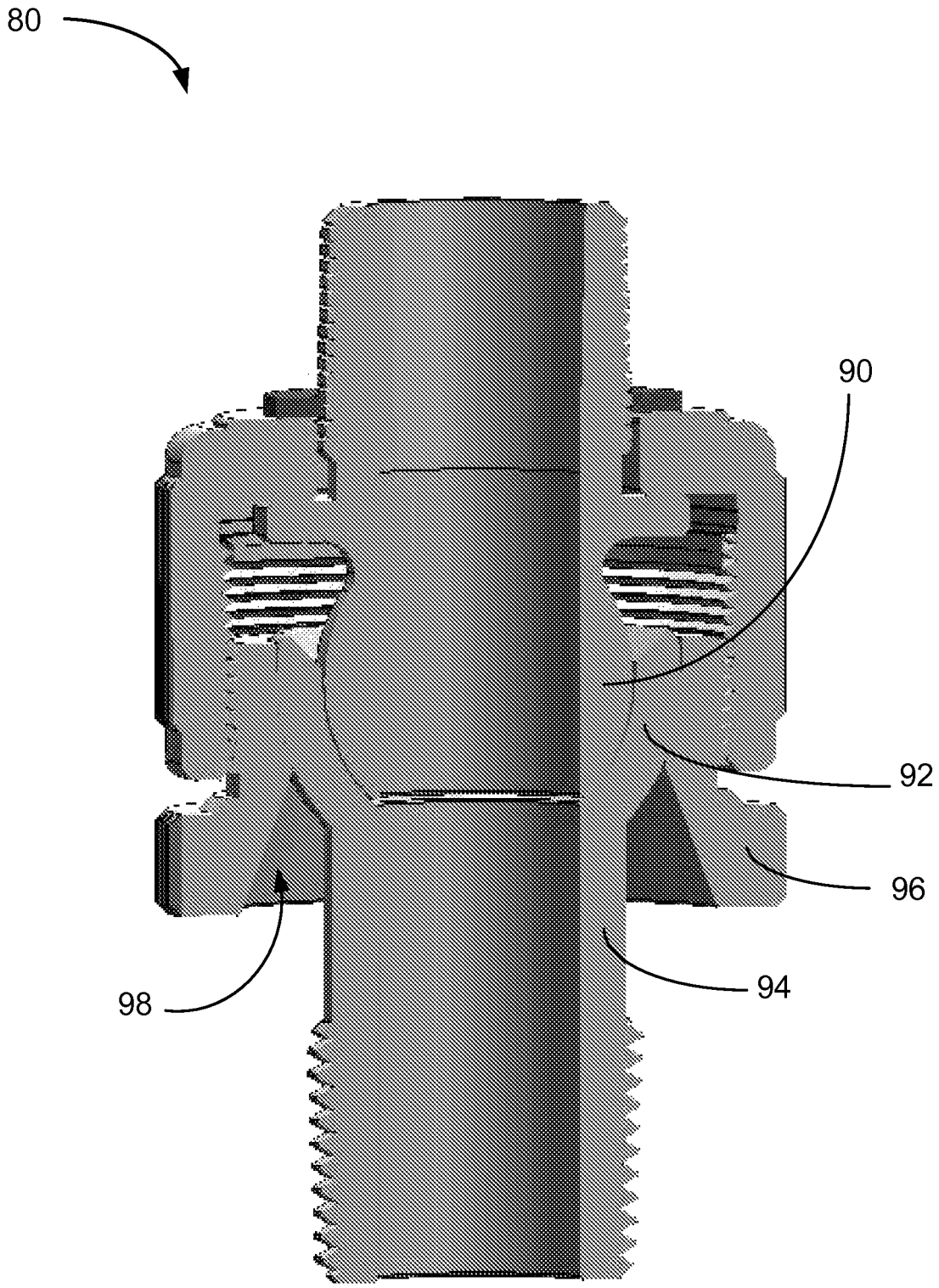
FIG. 17 is a cross-section view of a swivel fixture, as used in the modular lighting system of the present invention.

FIG. 17 shows a cross section of the swivel fixture mechanism, which includes an inner ball 90 within an outer ball 92 with attached mounting tube 94, and a locking ring 96 which screws and unscrews. When the locking ring 96 is unscrewed, the outer ball 92 is free to pivot within the confines of a cut-out region 98. The locking ring 96 is then tightened to lock the outer ball 92 and attached lamp in position.

Although the straight LED heat sink assemblies disclosed in co-pending. U.S. patent application Ser. No. 12/902,041, are suitable for use as the lamps 30 of the present modular lighting system 10, a specially designed LED heat sink assembly with a tapered end is preferred. It fits smoothly into the sockets, and its rear end is of smaller diameter, thus edges of rear portion will not contact the fixture as the swivel fixture is angled, and thus will not interfere with the positioning of the light beam produced.

Figure 18:
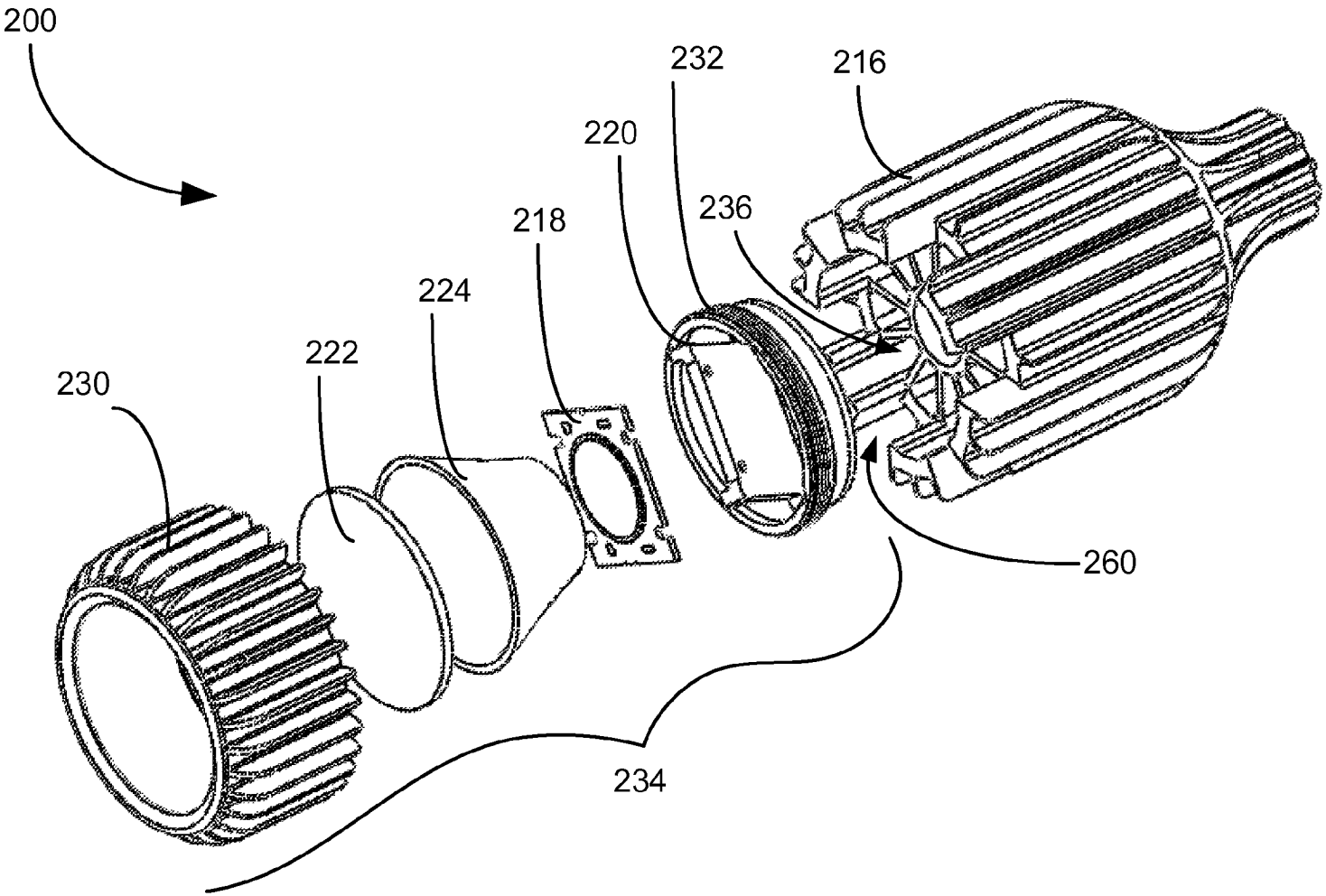
FIG. 18 shows an exploded isometric view of the LED heat sink assembly used in the modular lighting system of the present invention.
Figure 19:
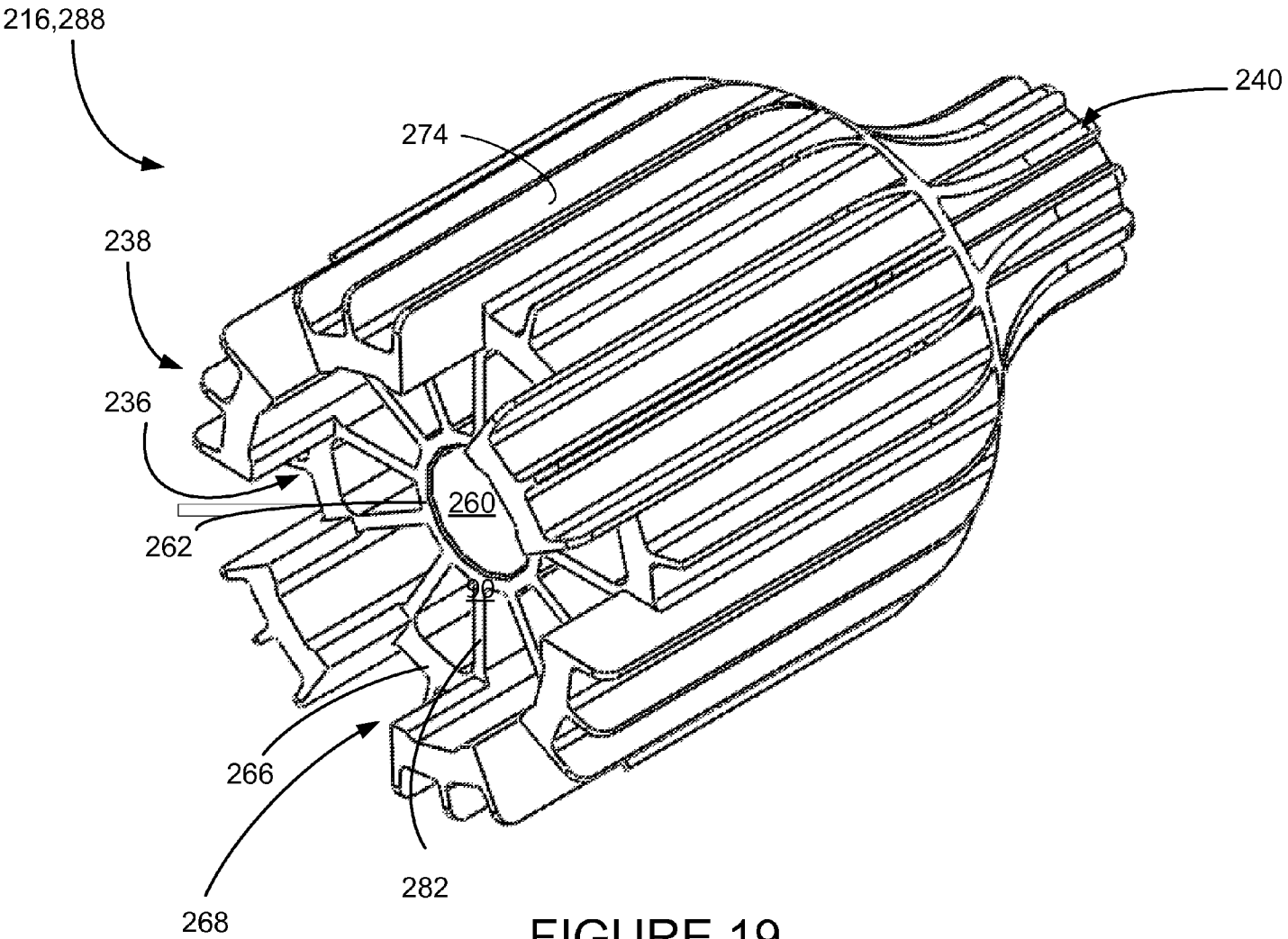
FIG. 19 shows an isometric view of the LED heat sink used in the modular lighting system of the present invention.

This tapered LED heat sink assembly 200 is shown in detail in FIGS. 18 and 19, and is shown as the lamp 30 element in FIGS. 1-16. The tapered LED heat sink assembly 200 has the basic elements shown in the exploded isometric view of FIG. 18. The LED module 234 fits into the tapered heat sink housing 216 to form the tapered LED heat sink assembly 200. The LED module 234 includes an LED 218, an LED housing 220, a lens 222, a reflector 224 and a cap 230, which attaches to the LED housing 220 by screw threads 232.

As shown in especially in FIG. 19, the LED housing 216 includes a tapered rear portion 240, which is tapered to present a smooth profile that blends into the lines of the swivel fixture 80 of the module 20, and provides free movement of the swivel fixture 80. The front portion 238 includes a recess 236 which is configured to receive the LED module 234 (see FIG. 18).

The tapered heat sink housing 216 is of a finned concentric tube 288 configuration. This includes an inner tube 262 surrounding a central bore 260 and an outer tube 266, and has internal fins 282 connecting the two tubes 262, 266. External fins 274 are also preferably included, and these elements have been carefully analyzed and designed with regard to multiple parameters, such as thickness, height and spacing, to give very efficient air flow and heat transfer away from the LED module 234. These parameters are discussed at length in co-pending U.S. patent application Ser. No. 12/902,041.

This finned concentric tube configuration 288 is especially effective at providing excellent heat transfer from the LED module 234. When used with the support tubes 82, angled support tubes 84 or the swivel turrets 80 of the lighting system 10, the central bore 260 of the LED heat sink housing 216 roughly aligns with the hollow interior of the tube 82, 84 or the swivel fixture 80, thus providing a cooling air channel which extends from the LED housing 220, through the LED heat sink housing 216, through the tubes 82, 84 or swivel fixture 80 and out into the open to provide excellent air circulation. This air circulation is also aided by air entering the side vents 268 of the heat sink housing 216 and from a cooling cavity formed between the back of the LED housing 220 and the body of the heat sink housing 216, as discussed in co-pending U.S. patent application Ser. No. 12/902,041.

The lighting module 20 can be programmed to be turned on and off at various times of day or to be dimmed or brightened to any desired level. The module 20 includes internal programmable controller circuitry 14 which can be programmed by a wireless controller 12, (see FIG. 1) which can be a hand-held device. The LED module controller can be controlled and programmed by a Wi-Fi control by a wireless wall unit, by a Blackberry or other hand held device. The LED module controller can communicate with other controllers in the same building or outside area. The LED module can be controlled with an astronomical clock system to keep track of time without the use of photocells, so the LEDs turn on or off at any specified time. The LED controllers can have a GPS system to allow them to be tracked by location using a GPs system. The LED module controller can talk with a remote lighting sensor to automatically adjust to the amount of daylight coming into the room or area. The LED module controller can adjust to compensate for override controls by the user.

While various embodiments have been described above, many alternatives, modifications and variations will be apparent to those skilled in the art, and it should be understood that they have been presented by way of example only, and not limitation. Various changes may be made without departing from the spirit and scope of this invention as recited in the following claims.

INDUSTRIAL APPLICABILITY

The present the modular lighting system 10 with LED heat sink assemblies 200 is well suited generally for lighting applications, both indoor and outdoor, and for both personal and commercial use.

There is a great scope of variation in the size and configuration of living and commercial spaces, and designing illumination sources which are adaptable within this great scope of variation is therefore challenging. Living or commercial spaces are seldom strictly rectangular and often incorporate angles and corridors which can cause shadows and produce dimly lit areas, which may be undesirable for inhabitants and residents.

It is therefore advantageous to have a lighting system which is expandable, and which can be easily configured or re-configured to illuminated irregularly shaped areas, or areas in which the lighting needs may vary. A modular system which is expandable and adaptable may have great benefits when using illumination sources in these spaces.

LEDs are solid state devices which are becoming used in more and more applications due to their greater energy efficiency and low operating costs. If operated at low currents and at low temperatures, LEDS are subject to very limited wear and tear. Typical lifetimes are estimated to be 35,000 to 50,000 hours of useful life, compared to 10,000 to 15,000 hours for fluorescent tubes, and 1,000-2,000 hours for incandescent light bulbs. LEDs are also less fragile than fluorescent and incandescent bulbs, and are less susceptible to damage by external shock. LEDs produce more light per watt than incandescent bulbs, and have been found to have significant environmental benefits compared to other alternatives. It has been estimated that a building's carbon footprint from lighting can be reduced by 68% by exchanging all incandescent bulbs for new LEDs.

The present modular LED lighting system 10 provides a modular system having a small number of standardized elements which can be combined in a great variety of ways to provide a great number of unique varied configurations. The modular lighting system 10 generally includes at least one module 20, which includes a power supply 22, having a housing 24, which is a circular housing 28, or an ovoid housing 29, and power cord 26. A module 20 also includes a number of lamps 30, which preferably include LED lamps 32, which are housed in heat-sinks 34. A module 20 also includes a support frame 40, which include a number of hub assemblies 42, of which there are numerous types, and connectors 44. The modules may take many forms, of which the zig-zag configuration 100 is only one of a great number of configurations which can be constructed from the elements of the lighting system 10.

Hub assemblies 42 included in the modules 20 may be of various types. These include an eight-slot hub 48 so called because there are eight interlocking slots 50 opened in the peripheral wall 52 of the hub 46. In the detail view of a zig-zag configuration 100 pictured in FIG. 5, an eight-slot hub 48 is shown on the right hand into which two interlocking connectors 44 have been inserted into two of the interlocking slots 50, and are attached to the hub 46. The hub assembly 42 on the left-hand is at the end of the zig-zag configuration 100, and is thus configured as an end hub 56, having only a single interlocking slot 50, which is filled by a single interlocking connector 44.

The eight-slot hub 48 and an end hub 56 are shown being connected by an interlocking connector 44. Thus the eight-slot hub 48 has two of the eight interlocking slots 50 filled with interlocking connectors 44, and the other six slots are filled with plugs 54. The end hub 56 has only one interlocking slot 50, which is filled with an interlocking connector 44. It can be seen that both ends of the interlocking connector 44 have flanges 45, which mate with the slot flange recesses 51 of the interlocking slots 50. The connector flanges 45 and the slot flange recesses 51 are thus referred to as interlocking flanges 53. The plugs 54 are also designed with flanges 45, so they also interlock with the slot flange recesses 51 to keep them in place. A screw plate 63 and an end cap 64 is later affixed into place which prevents the interlocking connector 44 from leaving the interlocking slot 50

There is a hollow channel 49 in the body of the interlocking connector 44. This can be used for channeling the electrical wiring from the power supply 22 to the lamps 30.

It is apparent that either of the end hubs 56 could be replaced with eight-slot hubs 48 and the support frame 40 thus extended to five, six or more hubs and lamps. It is also apparent that the lamps 30 could have been arranged in a straight line rather than a zig-zag, depending on which slots interlocking connectors 44 are inserted in the hub assemblies 42.

One of the eight-slot hubs 48 is attached directly to the power supply 22, by a power conduit 64 and thus will be referred to as a direct hub 58. Electrical wiring 60 passes directly into this direct hub 58, as well as wiring that is routed to the other non-direct hubs 62 through connectors 44, eventually to be connected to the lamps 30.

The three non-direct hubs 62 are fitted with screw plates 63 and end caps 64, which keep the connectors 44 interlocked with the hubs 46, and maintain the assembly of the hub assemblies 42. The interlocking connectors 44 also have connector caps 66.

The zig-zag configuration 100 is of course, only one of many possible configurations that can be constructed using eight-slot hubs and end hubs. Three other useful configurations constitute alternate preferred embodiments. These are shown for purposes of illustration, and of course, the configurations possible are not limited to these. These include 1) a five-lamp configuration 110 which has been constructed using an eight-slot hub 48 and four end hubs 56, 2) a nine-lamp star configuration 120 which has been constructed from a central eight-slot hub 48 and eight end hubs 56, where connectors 44 radiate from the central direct hub 58 in a star shape, and 3) a nine-lamp square configuration 130 which has been constructed from a central eight-slot hub 48 and eight more eight-slot hubs 48, where four connectors 44 radiate from the central direct hub 58 in an X-shape, and eight additional connectors which are used to create a square shape.

It is apparent that the hubs do not need to be configured only with either eight slots or only one slot. The hubs could be designed with 2, 3, 4, or almost any other number of slots, as long as there is enough material after the slots have been removed from the peripheral wall that the hub is physically capable of supporting the desired number of connectors. In particular, a six-slot hub has been found to be useful, which uses a central six-slot hub 70 and six end hubs 56 in a star-shaped pattern. This is only one example of the variations in hub design and modular configuration that can be created using the present invention.

It has been found to be useful to have one power supply for each nine lamps, mostly for ease of programming the illumination areas, but this also is not to be construed as a limitation. The embodiments shown so far have all utilized only one power supply, but it will be obvious that more elaborate configurations can be constructed with the support frame structures of several different modules linking up to create a network of hubs and connectors that can cover a great expanse of area, and yet be very adaptable to angles and corridors in the living space to be illuminated.

The power supply 22 is not necessarily circular in cross-section, but one alternative is an ovoid power supply 29, which may be useful when a larger number of lamps is being powered by providing more interior space for components.

The preferred lamp 30 for use with the modular lighting system 10 is an LED heat sink assembly 200. For use with this modular lighting system 10, a specially designed LED heat sink assembly with a tapered end is preferred. It fits smoothly into the support frame, and its rear end is of smaller diameter than the front end, thus edges of rear portion will not contact the support if a swivel turret is used to angle the lamp. This allows a greater range of directions for the light beam produced.

This tapered LED heat sink assembly 200 has an LED module 234 that fits into the tapered heat sink housing 216 to form the tapered LED heat sink assembly 200. The LED module 234 includes an LED 218, an LED housing 220, a lens 222, a reflector 224 and a cap 230, which attaches to the LED housing 220 by screw threads 232. The tapered rear portion 240 is shaped to present a smooth profile that blends into the swivel turrets 14 of the fixture 10, and provides free movement of the swivel turret. The front portion 238 includes a recess 236 which is configured to receive the LED module 234.

The tapered heat sink housing 216 is configured as a finned concentric tube configuration 288. This includes an inner tube 262 and an outer tube 266 which have internal fins 282 connecting the two tubes 262, 266. External fins 274 are also preferably included, and these elements have been carefully analyzed and designed with regard to multiple parameters to give very efficient air flow and heat transfer away from the LED module 234.

This finned concentric tube configuration 288 is especially effective at providing excellent heat transfer from the LED module 234. When used with the support tubes 82, angled support tubes 84 or the swivel turrets 80 of the lighting system 10, the central bore 260 of the LED heat sink housing 216 roughly aligns with the hollow interior of the tube 82, 84 or the swivel fixture 80, thus providing a cooling air channel which extends from the LED housing 220, through the LED heat sink housing 216, through the tubes 82,84 or swivel fixture 80 and out into the open to provide excellent air circulation. This air circulation is also aided by air entering the side vents 268 of the heat sink housing 216 and from a cooling cavity formed between the back of the LED housing 220 and the body of the heat sink housing 216.

Many variations of the modular lighting system 10 are possible, and they are very adaptable to a variety of applications. The LED module 234 can hold a variety of different lenses i.e.: clear, prismatic, frosted, linear, etc. It is possible to use an extended cover with varying focal properties to change light beam spreads. An additional focal optic can be added to allow the different focal beam spreads. This will allow the lighting system 100 to be place at a higher level in the building or outside application such as parking and street lighting. Different lens options can be added to enhance the light output or change the direction of the light output such as diffusion or linear spread of light in a line. Different color temperature LEDs can change the color output of the light.

Color changing LED's with red, green, blue and white LED's can be used. The LEDs 218 in the system 100 can be dimmed in an almost continuous manner, in digital steps of 0 to 255 levels or more if needed, unlike fluorescent lights, which require certain threshold voltages to remain illuminated.

The lighting module 20 can be programmed to be turned on and off at various times of day or to be dimmed or brightened to any desired level. The module 20 includes internal programmable controller circuitry 14 which can be programmed by a wireless controller 12, (see FIG. 1) which can be a hand-held device. The LED module controller can be controlled and programmed by a Wi-Fi control by a wireless wall unit, by a Blackberry or other hand held device. The LED module controller can communicate with other controllers in the same building or outside area. The LED module can be controlled with an astronomical clock system to keep track of time without the use of photocells, so the LEDs turn on or off at any specified time. The LED controllers can have a GPS system to allow them to be tracked by location using a GPs system. The LED module controller can talk with a remote lighting sensor to automatically adjust to the amount of daylight coming into the room or area. The LED module controller can adjust to compensate for override controls by the user.

The modular lighting system 10 can be configured as a canopy, or as a linear track. The LED heat sink assemblies 200 can be different sizes, and they can be fabricated in any color, and can be made of different materials such as aluminum, copper, brass, etc. The LED module 234 itself can have different shapes and sizes of shapes, and the present tapered heat sinks housings 216 can be configured to receive them.

In short, almost anywhere that standard lighting is used, the present modular LED lighting system can be used. The savings in energy use and the reduction in the carbon footprint created can have huge environmental and social benefits.

For the above, and other, reasons, it is expected that the modular LED lighting system 10 of the present invention will have widespread industrial applicability. Therefore, it is expected that the commercial utility of the present invention will be extensive and long lasting.

What is claimed is:

1. A modular lighting system, comprising:

at least one power supply;

a plurality of lamps;

a plurality of hub assemblies, each hub assembly having at least one interlocking slot; and at least one interlocking connector, which interlocks with one of said at least one interlocking slot, wherein said lamps comprise LED lamps each of which comprise a tapered LED heat sink assembly comprising:

a heat sink housing which is configured as a finned concentric tube configuration with a tapered end and having a recess for receiving an LED module; and an LED module which is fitted into said recess.

2. The modular lighting system of claim 1, wherein:

said hub assemblies include multi-slot hubs and end hubs.

3. The modular lighting system of claim 2, wherein:

said multi-slot hubs and said end hubs include slot flange recesses and said connectors include interlocking flanges which engage said slot flange recesses to interlock the hubs and connectors.

4. The modular lighting system of claim 1, wherein said heat sink housing includes external fins.

5. The modular lighting system of claim 4, wherein said finned concentric tube configuration includes an inner tube and an outer tube which are connected by internal fins.

6. A modular lighting system, comprising:

at least one power supply;

an expandable support frame; and a plurality of LED lamps which are attached to said expandable support frame wherein each of said plurality of LED lamps is a tapered LED heat sink assembly having a tapered heat sink housing which is configured as a finned concentric tube configuration and having a recess for receiving an LED module; and an LED module which is fitted into said recess.

7. The modular lighting system of claim 6, wherein: said tapered heat sink housing has a central bore, which provides a cooling air channel that provides cooling air to said LED module.

8. The modular lighting system of claim 6, further comprising programmable control circuitry.

9. The modular lighting system of claim 6, wherein: said expandable support frame includes interlocking hubs and connectors.

10. The modular lighting system of claim 9, wherein: said interlocking hubs include multi-slot hubs and end hubs.

11. The modular lighting system of claim 10, wherein: said multi-slot hubs and end hubs include slot flange recesses and said connectors include interlocking flanges which engage said slot flange recesses to interlock the hubs and connectors.

12. The modular lighting system of claim 6, wherein: said expandable support frame includes direct and non-direct hubs.

13. The modular lighting system of claim 6, wherein: said expandable support frame includes angled support tubes.

14. The modular lighting system of claim 6, wherein: said expandable support frame includes swivel fixtures.

15. The modular lighting system of claim 6, wherein: each of said plurality of LED lamps is an LED heat sink assembly.

16. The modular lighting system of claim 8, wherein said programmable control circuitry is wirelessly controllable.

* * * * *